United States Patent [19]

Benson et al.

[11] 4,307,792

[45] Dec. 29, 1981

[54] FORKLIFT ROLLER MAST LOCK

[75] Inventors: Samuel L. Benson, Vermillion; Louis T. Jensen, Vigo, both of Ind.

[73] Assignee: J. I. Case Company, Racine, Wis.

[21] Appl. No.: 131,511

[22] Filed: Mar. 18, 1980

[51] Int. Cl.[3] ..... B66B 9/20

[52] U.S. Cl. ..... 187/9 E

[58] Field of Search ..... 187/9 R, 9 E, 10, 11

[56] References Cited

U.S. PATENT DOCUMENTS 3,221,840 12/1965 Weinert ..... 187/9 E

*Primary Examiner*—Stanley H. Tollberg

*Attorney, Agent, or Firm*—Dressler, Goldsmith, Shore, Sutker & Milnamow

[57] ABSTRACT

A lock holds together two masts of a multi-stage forklift truck. A spring-loaded bolt carried by the inner mast is forced into an opening in the outer mast when the carriage is lowered to a position lower than the lowest edge of the inner mast. With the lock engaged the carriage may be raised from its lowest position without forcing the inner mast to rise from its lowest position. Once the carriage has been raised to clear the lower edge of the adjacent mast, the two masts are then unlatched. The latching mechanism allows the amount of travel of a carriage relative to the adjacent mast to be extended without movement of the adjacent mast.

10 Claims, 6 Drawing Figures

FORKLIFT ROLLER MAST LOCK

DESCRIPTION

1. Technical Field

A lock for the telescoping mast of a fork-lift truck. Specifically, a lock for a multiple-stage forklift truck mast having free-lift.

2. Background of the Invention

The forklift truck is truly the maid-of-all-work in warehousing and material handling operations. The forklift family includes pure forklift trucks, reach trucks, turret trucks, sideloaders, and free-path order pickers. While the forklift truck has become highly developed, new demands and requirements often give rise to new problems.

Before proceeding, a review of some nomenclature is in order. The forks or load-bearing portion of a forklift are carried on a carriage assembly. The carriage assembly moves along one or more upright masts. In the case of a two-mast design, the carriage rides on an inner mast and the inner mast rides on a fixed outer mast. By "free-lift" it is meant that the lifting movement of the carriage is allowed to occur before the uprights or masts are allowed to extend.

Certain forklift trucks are characterized as having a "rough terrain" capability. The rough terrain designation refers to the particular surface or grade environment in which the forklift must operate. In general, the greater distance between the bottom of the wheels and the bottom of the body or frame of the truck or machine, the greater the capability of that truck or machine for operating in rough terrain. On the other hand, in almost every forklift truck design, it is desirable that the forks can be lowered to the maximum extent. This allows the forklift to be used to pick up loads resting on the floor or even at an elevation below the bottom of the wheels of the forklift.

In one specific instance, a forklift used in military applications, these two relatively conflicting requirements (i.e., requirement for maintaining a relatively high ground clearance so as to enable that machine to operate in rough terrain and the requirement that the forks or carriage assembly should go lower than the level of the bottom of the wheels) were levied in the same specification. In order for the two requirements to be satisfied, the forks and their carriage must be raised after loading so as to meet the rough terrain requirement. For example, it was specified that there should be at least an 11-inch ground clearance and that the forks be capable of being lowered to a level of at least 4 inches below the level of the bottom of the wheels.

Another requirement often placed on forklift trucks is that they be capable of operating in a confined environment. Specifically, with the advent and use of containerized vehicles for shipment and storage, a forklift truck must be capable of entering and manipulating loads within the container or van. This requirement, that the forklift be capable of working within a container, conflicts with still another requirement. That requirement is that the forklift be capable of raising loads to the highest level possible once the forklift has left the container.

The requirement of lifting loads to the highest level possible is often met or satisfied by the installation of a multiple-stage mast assembly. Such multiple-stage mast assemblies are complicated in the hydraulic sense and are often so bulky as to restrict either the load-carrying capability or the maneuverability of the forklift truck.

Consequently, for forklift trucks used in containerized service applications, another requirement is placed on the designer to the effect that the forks and their associated carriage must be capable of being raised without the masts of the forklift truck moving from their retracted position.

Forklift trucks having three or more stages permit high stacking without suffering the penalty of height when the mast is retracted. However, because of the complex hydraulics and chain lifts associated with a forklift having more than two stages of lift, loss of load center is often experienced. More significantly, these forklift trucks cost from 30–50% more than a two-stage forklift. Therefore, absent any special engineering considerations to the contrary, a two-stage forklift design is preferred.

The difficulties in balancing these conflicting requirements is often left to the individual bidder seeking such a contract. Because most suppliers, in the interest of saving costs, try to use as many standardized parts and conventional or proven designs as possible, a unique design problem is presented with each new contract. It is under these circumstances that the present invention was developed. The problem facing the inventor was one of satisfying several basically conflicting requirements. Specifically, he was to design a vehicle having:

(1) at least 11-inch ground clearance (a so-called rough terrain vehicle);

(2) forks that could be lowered to a level at least 4 inches below the bottom of the wheels supporting the forklift; and (3) a mast structure suitable for use within a containerized van.

Furthermore, since the masts in the lowered or folded position must be kept at least 11 inches off the ground to provide adequate clearance; since the forks must be capable of being lowered at least an additional 15 inches; and since it is desirable (in almost all cases in a forklift having a free-lift capability) to have the carriage assembly capable of being raised to the highest level possible beyond the upper edge of the inner mast, then it is necessary to install a set of rollers or guides as close as possible to the bottom of the carriage. However, it was found that if the carriage was lowered to a level below the lowest level of the adjacent or inner mast, the lowest roller dropped below the lower edge of the adjacent mast. If the forks were then loaded, the roller would abut or engage the mast. More importantly, with the carriage assembly in this position, any attempt to raise the forks would result in the inner mast also being raised. Since the masts are made as tall as possible consistent with the limited confines of a containerized van, any attempt to raise the forks would result in the inner mast being raised to the point of striking the overhead or ceiling of the container. This is an unacceptable condition!

Consequently, a means or mechanism had to be provided that insures the inner mast is not raised when the forks are initially raised. Thus, the problem becomes one of providing a mechanism allowing the carriage to be raised while the inner mast is held down. On the other hand, once the carriage has been driven free from the lower edge of the adjacent or inner mast, the mechanism must free the mast to allow its extension.

Finally, because the forklift was to be used by the military, it was desirable that any such locking mechanism be virtually foolproof in the sense that it cannot fail. At the same time little or no care and attention should be required. In essence a simple foolproof design was preferred. It is within this matrix of constraints that the inventor devised the apparatus that is the subject of the present invention.

SUMMARY OF THE INVENTION

In accordance with the present invention, a latching mechanism is provided between two masts of a forklift truck to lock those masts together when the carriage has been lowered to its lowest position. Specifically, a spring-loaded catch bolt is carried by the inner mast of a two-stage forklift; the outer mast carries a catch plate which cooperates with the catch bolt on the inner mast to lock the two masts together. The carriage on the forklift is provided with a camming surface. When the carriage is lowered from an intermediate position to its lowest position, the camming surface triggers the catch bolt to engage the catch plate thereby holding the two masts locked together. When the carriage is raised from its lowest position to an intermediate position, the camming surface frees the spring-loaded catch bolt to disengage from the catch plate thereby unlocking the two masts. Once the two masts are unlatched, the inner mast may be extended from its folded position to raise the carriage assembly.

Numerous other advantages and features of the present invention will become readily apparent from the following detailed description of the invention and the embodiment described, from the claims and from the accompanying drawings in which each and every detail shown is fully and completely disclosed as part of this specification, and in which like numerals refer to like parts.

DETAILED DESCRIPTION

Figure 1:
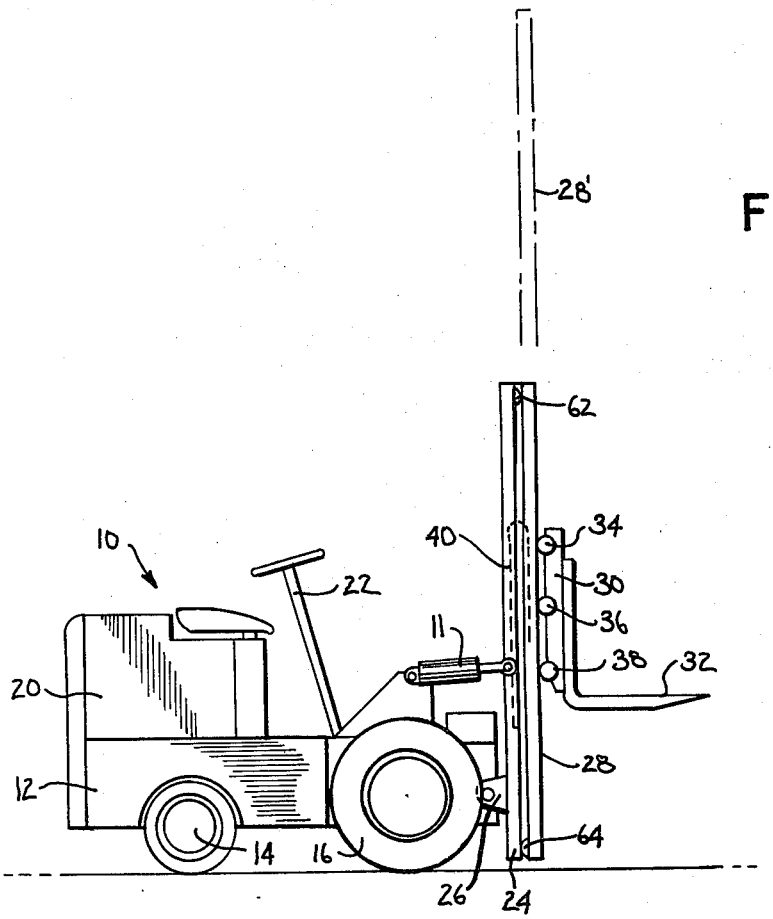
FIG. 1 is a side elevational view of a fork-lift incorporating the apparatus that is the subject of the present invention.

While this invention will be described in connection with a preferred embodiment, it will be understood that it is not intended to limit the invention to that specific embodiment. On the contrary, it is intended to cover all alternatives, modifications, and equivalents as may be included within the spirit and scope of the invention as defined by the appended claims.

Other devices have been used to lock the lifting masts of a forklift truck together.

Schroeder (U.S. Pat. No. 2,059,150) teaches the construction of a mechanism for a two-stage fork-lift to prevent a secondary set of uprights from moving relative to a primary set of uprights. The problem to be avoided was the specific situation where the platform carrying the forks "binds" relative to the secondary uprights so that the movement of the platform to the full upward or upper position is resisted. Specifically, he uses a pair of forked members held in a cocked position by a spring to lock two uprights together. A release cam is actuated only when the lifting platform is fully raised. Abbe, U.S. Pat. No. 2,261,930 and Barnes U.S. Pat. No. Re. 25,432 also teach a lock mechanism released only when the lifting platform has been fully raised.

Kelley U.S. Pat. No. 3,768,595 filed July 15, 1970 provides an interesting summary of the state of the art of latching mechanisms between mast sections. His conclusion is that for the most part these latching mechanisms were only released when one of the mast sections was fully extended and that this design concept resulted in overloading of the bearings between the two mast sections since many lifts do not require extension of the inner section of a 3-stage forklift. In other words, the loading conditions are a function of the amount of vertical overlap between the various mast sections. He employs two latches. A first latch locks the intermediate upright to the outer and the second latch locks the intermediate mast of the inner upright. The first latch being unlocked at an intermediate position of the raising hydraulic cylinder assembly. The second latch is released when the load carriage has reached its highest point of travel relative to the inner mast. Specifically, each latch comprises a pair of hooked elements pivoted on a common shaft and facing in opposite directions. This arrangement of latches provides that the inner upright or mast remains locked and travels with the intermediate upright for only a short distance. Thereafter it is unlocked from the intermediate and locked to the load carriage. This insures that the uprights extend simultaneously maintaining a maximum overlapped relationship inner-to-intermediate-to-outer, which progressively decreases as the mast extends to its full height. Thus, loads are distributed on the rollers between the mast at near optimum conditions for all mast positions. Quayle U.S. Pat. No. 3,187,842 describes a similar arrangement without maintaining maximum overlap between mast sections.

Ramsey U.S. Pat. No. 3,786,902 teaches an escapement mechanism triggered by the lifting mechanism to hold together the inner mast and outer mast during the free-lift of the carriage assembly. Specifically, the escapement mechanism restrains upward movement of the inner mast while the carriage is being lifted anywhere between its fully lowered position and its uppermost free-lift position.

Hansen U.S. Pat. No. 3,561,568 concerns himself with the problem which arises when the elevation of the carriage is terminated at any point along either of its last two stages of elevation. Specifically, if the carriage is then lowered, the extended mast section may tend to cock or otherwise stick in an elevated position relative to the stationary mast. Continued lowering of the carriage leaves the stuck mast relatively unsupported except for frictional engagement with the stationary portions of the lifting mechanism. The extended mast could drop suddenly and damage the mast assembly or the load supported by the forked carriage. He provides a means for positively urging the mast assemblies downwardly during the descent of the carriage from any position in which the mast assembly is extended from the stationary portions of the forklift.

Finally, Vance U.S. Pat. No. 2,603,368 provides an electronic control system whereby the upright mast where the mast of a roll-clamping industrial lift truck is prevented from rotation only when the clamping mechanism is above a certain minimum height. From a safety standpoint, it is of particular importance that when loaded, the load not be elevated beyond a certain point and tilted forward beyond a certain angle so as to prevent the forklift truck from becoming unstable. He uses a tilting control system which after the clamp has been elevated to the certain height further elevation of the mast is prevented. For purposes of this discussion, Vance is cited as a reference to illustrate an electronic means to control the height and position of the telescoping mast structure.

Thus, it is seen that the prior art has attempted to overcome the problems of sticking masts, overlapping masts and frozen carriage assemblies by means of springs, lost motion connections and even electrical circuitry. The various latching arrangements that have been developed, for the most part, tend to be complex and unreliable due to the excessive dependence latching and locking mechanisms employing a relatively large number of parts and parts put into operation by relative motion between the masts and the carriage along the full range of raising and lowering cycles. Furthermore, practitioners in the art have concentrated their efforts on mechanisms triggered into operation only when the masts have been fully extended or the carriage has reached the end of its upward travel. The present invention overcomes the shortcomings and difficulties by a relatively simple, but nevertheless novel, solution to the problem presented. It should, of course, be recognized that the particular problem to which the present invention is addressed is unique and not otherwise considered by the prior art.

Referring to FIG. 1, it will be seen that the truck 10 comprises a main frame 12 supported at its rear end by a pair of wheels 14 and at its forward end by a pair of driving wheels 16. The truck 10 is further provided with an internal combustion engine or battery-powered engine 20, connected through a suitable clutch and power transmission mechanism to the driving wheels 16 and with a steering wheel 22 and a suitable mechanism (not shown) joined to the rear wheels 14 to steer the machine. In actuality the specific forklift design to which the prototype mast lock was installed has an articulated frame with power applied to all four wheels. The principles of the invention may be applied to any forklift truck body or frame.

The principles of the present invention are applicable to load-lifting mechanisms incorporating an extensible framework, commonly termed a "mast", made up of a plurality of "sections", usually two or more in number. The term "mast section", refers to one stage of the mast. Such a section typically comprises a rectangular framework made up of a pair of horizontally spaced and vertically extending "rails" suitably interconnected by horizontal cross braces and adapted to telescopically interengage with the rails of another such section of the mast. Within this context, the term "rails" refers to the vertical side members of a mast section. These rails are typically a mill-formed channel or I-beam which is commonly used in pairs as the uprights of a mast section. The term "ram" refers to the hydraulically operated piston and cylinder unit employed to impart vertical movement to the load-lifting mechanism. Typically, a simple two-part ram is made up of: a cylinder which constitutes the external or lower member of the ram and which remains fixed at its lower end to the lower fixed or outer mast section; and a plunger carrying a fluid-actuated piston and which telescopes within the cylinder so as to movably extend from the upper end thereof. Other multi-part ram constructions are known to those skilled in the art. These other multi-part ram constructions may be employed if desired. The term "carriage" refers to the apron which travels vertically on the uppermost or inner mast section. The carriage carries forks or other associated cantilever attachments which directly carry the cargo or load to be raised, lowered and/or transported. Finally, the term "chain" refers to the usual flexible load-supporting elements which transmit tension for loading and operatively interconnecting the ram, the mast sections and the carriage. These elements typically comprise the well-known roller chain since such a chain operates with a minimum of friction and stretch. Other interconnection mechanisms may be used.

With this nomenclature in mind, and referring to the figures, it is understood that at the front end of the truck 10, a stationary or outer mast 24 is pivotally connected to the main frame 12 of the truck 10 by a set of ears 26 and a pivot pin. The inner mast 28 is guided in movement along the outer mast 24 by a set of rollers 62, 64. The inner mast 28 is movable from a lowered position to a fully raised or extended position (shown in phantom in FIG. 1). The outer mast 24 may be mounted in a fixed upright position by a suitable bracing structure connected to the forward end of the truck 10 or may be pivotally mounted on the truck and connected by a pair of tilting rams 11 between the frame 12 and the outer mast 24. This pivoting action of the outer mast assists in controlling the center of gravity of the forklift 10 as the load is lifted. Conventionally, the outer mast 24 and the inner mast 28 are interengaged by a set of sliding rails.

Joined to the inner mast 28 is a load-lifting carriage 30. The carriage supports a pair of forks 32 (only one being shown). The carriage 30 is guided in movement along the inner mast 28 by a set of rollers 34, 36, 38. A multiple-stage hydraulic ram centered between the inner mast and the outer mast drives a chain 40 to raise the carriage 30 and the inner mast 28 relative to the outer mast 24.

Figure 6:
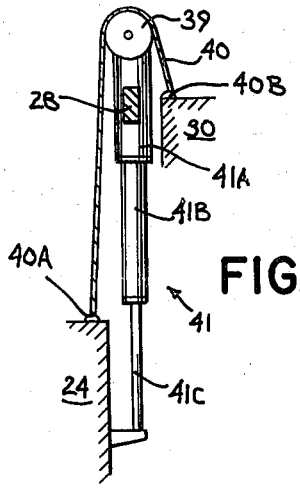
FIG. 6 is a schematic diagram of the lifting mechanism for the mast and carriage assembly shown in the drawings.

FIG. 6 is a schematic representation of the lifting mechanism used to move the carriage 30 and the inner mast 28. Specifically, a two-stage hydraulic ram 41 is used to tension the chain 40 to raise the carriage 30 and the inner mast 28. As shown in FIG. 6, one end 40A of the chain 40 is connected to the outer mast 24 and the other end 40B of the chain is fixed to the carriage 30. The chain 40 is reaved over a sprocket wheel 39 pivotally attached to the free end hydraulic ram 41.

The hydraulic ram 41 has two stages of lift. As hydraulic fluid is applied to the hydraulic ram 41, the widest or first cylinder 41A is driven from the intermediate cylinder 41B. After the widest cylinder 41A has been driven from the intermediate cylinder 41B, the hydraulic fluid applied to the ram 41 forces the piston rod 41C from the intermediate cylinder 41B. Thus, the hydraulic ram 41 has two stages of lift. The hydraulic ram 41 is positioned between the outer mast 24 and the inner mast 28. It should be remembered that the inner mast 28 is guided along the outer mast 24 (see FIG. 1).

Thus, with the inner mast 28 lowered and the carriage 30 in the lowest position (see FIG. 3) the hydraulic ram 41 is in its collapsed or folded position. As hydraulic fluid is applied to the ram 41, the intermediate cylinder 41B is driven from widest or first cylinder 41A. This drives the sprocket wheel 39 upwardly which applies tension to the chain 40 which, in turn, forces the carriage 30 in the upward direction. The stroke of the two stages of the hydraulic ram 41 is selected such that, with the intermediate cylinder 41B fully extended relative to the first cylinder 41A, the carriage 30 is elevated to its highest position relative to the inner mast 28. The continued application of hydraulic fluid to the ram 41 forces the piston rod 41C to be driven from the intermediate cylinder 41B. Since the carriage 30 is already in its highest or fully extended position relative to the inner mast 28, further extension of the ram 41 drives the inner mast 28 away from the outer mast 24; it will be recalled that the hydraulic ram 41 is juxtaposed between the inner mast 28 and the outer mast 24.

To lower the carriage 30 and the inner mast 28, it is only necessary to bleed off the hydraulic fluid from the ram 41. Since the area of the piston joined to piston rod 41C is smaller than the piston driving the intermediate cylinder 41B relative to the first cylinder 41A, the intermediate cylinder 41B and the piston rod 41C will telescope together before the intermediate cylinder 41B telescopes within the first cylinder 41A. Thus the inner mast 28 is lowered before the carriage 30. This discussion of the manner in which the carriage 30 and inner mast 28 move relative to the outer mast 24 has been given merely for understanding the means by which the forklift is raised and lowered. Other mechanisms, hydraulic rams, and roller chain combinations may be used without effecting the principle of this invention.

Further details of the structure and operation of the mast and carriage will become apparent from the following detailed description and from details shown in FIGS. 2 through 5. In these schematic views, some of the parts shown in FIG. 1 have been omitted to permit a clear illustration of the mechanism employing the present invention. Similarly, the schematic illustrations show only one of those elements which are employed in pairs. This is because the mast structure is essentially a symmetrical design and components are generally duplicated on either side of the vertical plane passing through the longitudinal axis of the truck 10.

Figure 2:
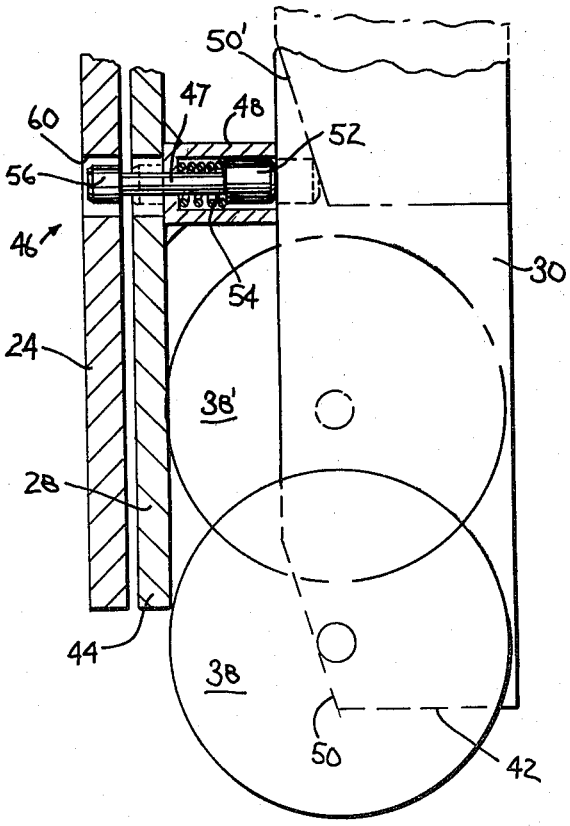
FIG. 2 is a detailed cross-sectional elevational view of an apparatus embodying the subject invention.

FIG. 2 is a detailed cross-sectional view of the lower end of the outer mast 24, the inner mast 28 and the carriage 30. Specifically, there is illustrated the situation wherein the inner mast 28 is in its lowest position and the carriage 30 is in its lowest position. Since the lower end 42 of the carriage 30 is lower than the lower end 44 of the inner mast 28, the lowest roller 38 of the three-carriage guide rollers 34, 36 and 38 abuts the lower end 44 of the inner mast 28. In particular, when a load is placed upon the forks 32, the cantilever action of the forks 32 and the carriage 30 relative to the inner mast 28 sets up an upsetting moment. This pivots the carriage 30 clockwise about its center roller 36 to the extent that the lower roller 38 engages the lower end 44 of the inner mast 28. Consequently, when the raising mechanism (see FIG. 6) is engaged to raise the carriage 30, the inner mast 28 and the carriage 30 will be lifted upwardly together. As seen in FIG. 2, once the carriage 30 has been raised from its lowest position, the lowest roller 38 no longer abuts or engages the lower end 44 of the inner mast 28. In this raised position, the lowest roller 38' is free to move along the inner mast 28.

To prevent the inner mast 28 from being raised together with the carriage 30, catch bolt assembly 46 is employed. Specifically, the catch bolt assembly 46 locks the inner mast 28 and the outer mast 24 together while the carriage 30 is raised from its lowest position. The catch bolt assembly 46 includes a spring-loaded shaft 47 and a housing 48. The shaft 47 is triggered by a camming surface 50 at the lower inside edge of the carriage 30.

As shown in FIG. 2, the spring-loaded shaft 47 is carried by a housing 48 joined to the inner mast 28. The shaft 47 features a generally cylindrical protuberance 52, 56 at each end. The housing 48 is in the form of a cylinder having an open end in the direction of the carriage 30 and a closed end in the direction of the outer mast 24. The shaft 47 is freely guided in the axial direction through a complementary opening in the closed end of the housing 48.

The shaft 47 includes a protuberance 52, 56 at each end. A coil spring 54 is positioned between the closed end of the housing 48 and the protuberance 52 facing the carriage 30. The protuberance 52 facing the carriage 30 serves three functions. It serves as an abutting surface communicating the force of the spring 54 between the shaft 47 and the housing 48. In the second instance, it guides the shaft 47 in the axial direction. This is because the outer surface of the protuberance 52 cooperates with the inner surface of the housing 48. Finally, the outer end of the protuberance 52 cooperates with the camming surface 50 at the lower inside edge of the carriage 30 to position the shaft 47 in the axial direction to overcome the force of the spring 54.

The other end of the shaft facing the outer mast 24 also includes a protuberance 56. This second protuberance 56 performs two functions. In the first case, it limits the axial movement of the shaft in the direction towards the carriage 30. In the second instance, it cooperates with an opening 60 on the outer mast 24 to lock the inner mast and the outer mast together. Specifically, this second protuberance 56 acts as a catch bolt and the complementary opening 60 on the outer mast 24 acts as a catch plate.

The operation of the latching mechanism 46 will now be described. The shaft 47 is free to move in the axial direction between a first position and a second position. The first position is shown in phantom on FIG. 2. The second position is shown with solid lines in FIG. 2. In the first position the inner edge 50 of the carriage 30 does not engage the first protuberance 52. Therefore, the spring 54 urges the shaft 47 in the direction of the carriage 30. The direction of movement away from the outer mast 24 and towards the carriage 30 is limited by the second protuberance 56. Specifically, when the second protuberance 56 engages the housing 48, further axial movement in the direction of the carriage 30 is prevented. When in this position, the second protuberance 56 is free from the opening 60 in the outer mast 24. Thus, the inner mast 28 and the outer mast 24 are free to move relative to one another.

In the second position of the shaft 47, the inner lower edge 50 of the carriage 30 engages and displaces the first protuberance 52 so as to compress the spring 54. Thus, when the shaft 47 is in its second position, the second protuberance 56 occupies the opening 60 in the outer mast 24. Relative motion between the inner mast 28 and the outer mast 24 is prevented by the engagement of the second protuberance with the opening 60. Thus, the two masts 24, 28 are locked together.

The latching mechanism 46 is positioned at a vertical elevation relative to the lower end 44 of the inner mast 28 such that the shaft 47 is free to move from the second position to the first position when the carriage 30 has been raised to a sufficient height where the lowest roller 38 no longer abuts or engages the lower end 44 of the inner mast 28. Similarly, the angle of the camming surface 50 and the stroke of the shaft 47 should be such that the two masts 24, 28 are locked together before the lowest roller 38 is free to engage or abut into the lower end 44 of the inner mast 28. Other dimensions and thicknesses should be apparent to one skilled in the art. More importantly, the latching mechanism 46 should be of such a strength that the raising force of the lifting mechanism 40 can drive the lowest roller 38 to "ride over" the lower end 44 of the inner mast 28 without deforming the shaft 47 relative to the housing 48.

The overall operation of the latching mechanism 46 will now be described with reference to FIGS. 3, 4 and 5. For purposes of illustration, the inner mast 28 and the outer mast 24 are shown guided together by two rollers 62 and 64.

Figure 3:
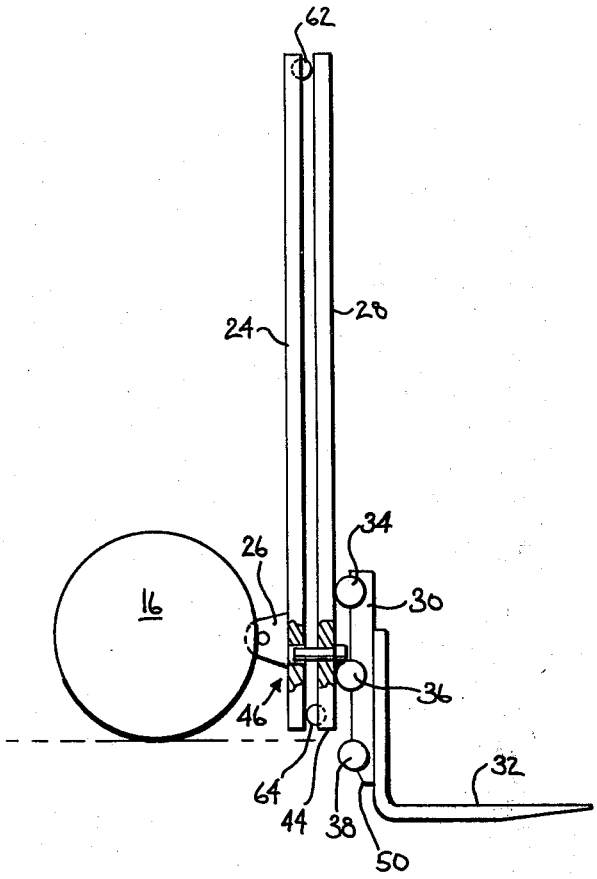
FIG. 3 is a partial side elevational view illustrating the forklift shown in FIG. 1 with both masts lowered and the carriage in the lowest position.

FIG. 3 illustrates the inner mast 28 and the outer mast 24 in the lowered position and the carriage 30 in the fully lowered position. When in this configuration, any load placed on the forks 32 will cause the carriage 30 to pivot in the clockwise direction about the center roller 36. This will force the lowest roller 38 to engage the lower end 44 of the inner mast 28. However, due to the latching mechanism 46 previously described, one end 56 of the shaft 47 engages the opening 60 within the outer mast 24. Thus, if the carriage 30 is raised, the inner mast 28 is prevented from moving upwardly relative to the outer mast 24.

Figure 4:
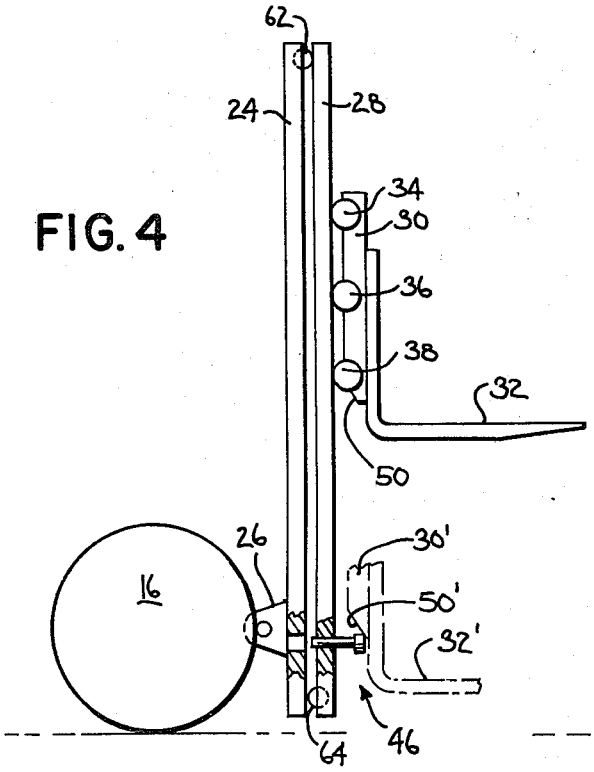
FIG. 4 is a partial side elevational view of the forklift shown in FIG. 3 with the carriage raised to an intermediate position.
Figure 4:
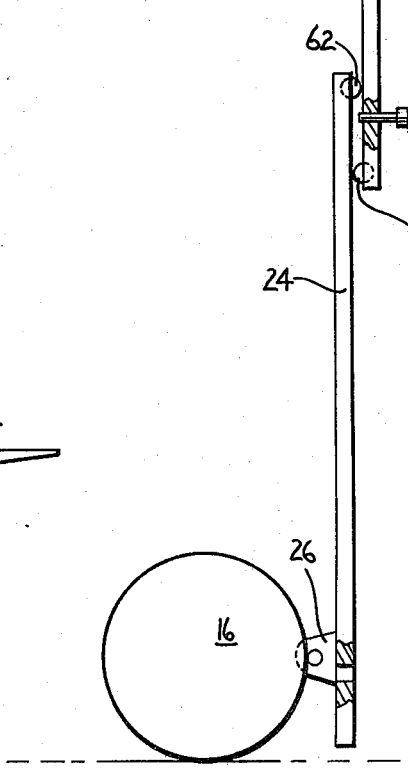

FIG. 4 illustrates the configuration of the carriage 30 after it has been raised from its fully lowered position. Specifically, when the carriage 30′ has been raised to such a height that the lowest roller 38 now rides on the inner mast 28, the shaft 47 is free to be repositioned by the spring 54 from its second position to its first position such that one end 56 of the shaft 47 no longer engages the opening 60 on the outer shaft 24. This is shown in phantom in FIG. 4. Thus, the inner mast 28 is now free to move upwardly relative to the outer mast 24.

Figure 5:
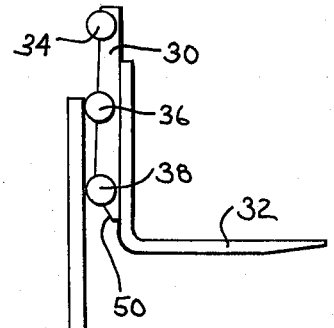
FIG. 5 is a partial side elevational view of the forklift shown in FIG. 4 illustrating the two masts in the extended position and the carriage in an intermediate position.

FIG. 5 illustrates a configuration with the inner mast 28 and the carriage 30 in the fully raised position. Specifically, there is illustrated a relationship between the center roller 36 and the lowest roller 38. It shows how the lowest roller 38 allows the carriage 30 to be raised to the fullest extent possible, while maintaining the carriage 30 in a guided relationship with the inner mast 28. When the controls for the forklift 10 are then manipulated to lower the forks, the inner mast 28 will be lowered relative to the outer mast 24 with the carriage 30 in the fully raised position. Finally, when the inner mast 28 has been fully lowered, the carriage 30 will then be lowered along the inner mast 28. Prior to being lowered to the lowest position, the camming surface 50 on the carriage 30 will engage one end 52 of the shaft 47 to overcome the force of the spring 54 and drive the shaft 47 from the first position to the second position. When in the second position, the inner mast 24 and the outer mast 28 will be locked together.

The above detailed description has been given for ease of understanding only. No unnecessary limitations are to be understood therefrom, as modifications will be obvious to those skilled in the art. It is, of course, intended to cover by the appended claims, all such modifications as fall within the scope of the claims.

What is claimed is as follows:

1. In a forklift truck having:

(a) an outer mast;

(b) an inner mast guided in movement along said outer mast with said inner and outer mast slidably joined together;

(c) a carriage guided in movement along said inner mast with said inner mast and carriage slidably joined together, said carriage in the lowered position abutting the lower end of said inner mast; and (d) means for moving said inner mast relative to said outer mast between raised and lowered positions and for moving said carriage relative to said inner mast between raised and lowered positions whereby upon engaging said moving means to raise said carriage said inner mast is raised with said carriage remaining in the lowered position, wherein the improvement comprises: a shaft and biasing means for the shaft carried by said inner mast and actuated by said carriage, for locking said inner mast to said outer mast by moving said shaft into an aperture defined by said outer mast until said carriage has been raised to an intermediate position being defined as a position between the raised and lowered positions of said carriage, said carriage when repositioned from the raised to the lowered position enaging said shaft to lock said inner and outer masts locked together, actuation of said moving means to raise said carriage from the lowered to the intermediate position with said inner and outer masts locked together whereby said carriage is raised before said inner mast is raised, said carriage when raised to the intermediate position disengaging said shaft and said shaft moving out of said aperture to free said inner from said outer masts.

2. In a forklift truck having:

(a) at least one movable mast, said movable mast having a first and a second elevated position relative to a fixed vertical reference point, said second position being higher in elevation than said first position;

(b) at least one other mast slidably joined to said movable mast;

(c) a carriage guided in motion along said movable mast between a third elevated position and a fourth elevated position relative to said fixed vertical reference point, the third position of said carriage being lower than the first position of said movable mast, said carriage engaging said movable mast with said carriage in the third position and said movable mast in the first position whereby the effect of raising said carriage is to raise said movable mast from said first position prior to said carriage being raised to said fourth position, wherein the improvement comprises:

(aa) a shaft carried by said movable mast at a position intermediate said first and second positions and free to move between locked and unlocked positions;

(bb) means, carried by said movable mast, for biasing said shaft to the unlocked position;

(cc) an aperture defined by said other mast and complementary to said shaft, said shaft when forced into said aperture locking said movable mast to said other mast; and (dd) a camming surface on said carriage, said camming surface engaging said shaft to overcome said biasing means to drive said shaft into said aperture upon repositioning said carriage from an elevation above said intermediate position to a lower position, said camming surface freeing said shaft to reposition in response to said biasing means and unlock said movable mast from said other mast upon raising said carriage above said intermediate position whereby upon raising said carriage from said third position with said shaft driven into said aperture said carriage disengages said movable mast without raising said movable mast from said first position.

3. The forklift truck defined in claim 2, wherein said aperture is defined on a plate carried by said other mast.

4. The forklift truck defined in claim 2, wherein said carriage is guided in position between said third and fourth positions and along said movable mast by at least one roller, said roller with said carriage in the third position and said movable mast in the first position abutting said movable mast whereby raising said carriage from said third position with said shaft engaging said aperture drives said roller free from said movable mast before said carriage is raised to the fourth position and before said movable mast is raised above said lowered position.

5. Apparatus for locking together two masts of a forklift truck, said forklift truck having a frame carrying at least three masts, a first mast moving vertically relative to a second mast between raised and lowered positions, said second mast moving vertically relative to a third mast between raised and lowered positions, said second mast being raised relative to said third mast from a lowered to a raised position after said first mast has been fully raised, said first mast having a lowered position relative to said second mast that is lower than the lowered position of said second mast relative to said third mast, said first mast in said lowered position having a member abutting the lower end of said second mast whereby with said second mast free to move relative to said third mast, raising said first mast raises said second mast before said first mast has been fully raised, comprising:

(a) a lock carried by said second and third masts, for holding together said second and third masts with said second mast in the lowered position, the lock including a guide carried by said second mast, a catch bolt free to move within said guide between a first and a second position, and an aperture defined by said third mast and complementary to said catch bolt, wherein said opening means includes means for biasing said catch bolt away from said aperture, said means for closing said lock forcing said catch bolt into said aperture with said first mast in the lowered position, said biasing means freeing said catch bolt from said aperture when said first mast is raised from the lowered position thereby unlocking said second mast relative to said third mast, lowering said first mast from the raised to the lowered position having the effect of overcoming said biasing means and forcing said catch bolt into said aperture thereby locking said second mast relative to third mast, said catch bolt being free to disengage said aperture after said first mast and the closing means carried thereon has been raised to a level generally equal to the level of said second mast in the lowered position relative to said third mast; and (b) means, carried by said first mast, for opening said lock by raising said first mast above its lowered position and for closing said lock by lowering said first mast from an elevation intermediate the raised and lowered positions of said first mast to its lowered position.

6. The apparatus defined in claim 5, wherein:

(a) said guide includes a plate generally perpendicular to the axis of travel of said catch bolt, said plate defining an opening through which one end said catch bolt is free to slide;

(b) said catch bolt is a shaft having a protuberance at one end, said cylinder protuberance passing through said opening in said plate; and (c) said means for closing said lock is a camming surface on said first mast, said protuberance abutting said camming surface defined on said first mast whereby said first mast drives said catch bolt to engage said aperture before said first mast is in its lowered position and said catch bolt disengages said aperture after said first mast has been raised to an elevation above the lower end of said second mast.

7. The apparatus defined in claim 6, wherein said aperture is formed by a catch plate carried by said third mast, said catch bolt aligned to said catch plate with said second mast in the lowered position relative to said third mast.

8. The apparatus defined in claim 7, wherein said catch bolt includes a second protuberance at the other end of said shaft, said second protuberance limiting the axial movement of said shaft towards said camming surface under the force of said biasing means, said second protuberance cooperating with said catch plate to hold said second and third masts together with said first mast in the lowered position.

9. The apparatus defined in claim 5, wherein said first mast defines the carriage of said forklift truck.

10. The apparatus defined in claim 5, wherein said third mast is fixed in position relative to the body of said forklift.

* * * * *